US007046136B2

(12) United States Patent
Sugimoto et al.

(10) Patent No.: US 7,046,136 B2
(45) Date of Patent: May 16, 2006

(54) PORTABLE TRANSMITTER HAVING TACT SWITCHES WITH FRONT FILM

(75) Inventors: Keiichi Sugimoto, Kariya (JP); Mitsuru Nakagawa, Chiryu (JP)

(73) Assignee: Denso Corporation, Kariya (JP)

( * ) Notice: Subject to any disclaimer, the term of this patent is extended or adjusted under 35 U.S.C. 154(b) by 195 days.

(21) Appl. No.: 10/819,962

(22) Filed: Apr. 8, 2004

(65) Prior Publication Data

US 2004/0200709 A1 Oct. 14, 2004

(51) Int. Cl.
*G08B 1/00* (2006.01)

(52) U.S. Cl. ..... 340/539.1; 340/407.1; 340/407.2; 340/693.5; 200/520; 200/521

(58) Field of Classification Search ..... 340/539.1, 340/407.1, 407.2, 693.5; 200/520, 521
See application file for complete search history.

(56) References Cited

U.S. PATENT DOCUMENTS 5,818,701 A * 10/1998 Shindo ..... 361/814
6,335,542 B1 * 1/2002 Miyasaka ..... 257/66
6,366,538 B1 * 4/2002 Anderson et al. ..... 368/10
6,850,547 B1 * 2/2005 Goto ..... 372/43.01

FOREIGN PATENT DOCUMENTS

JP A-10-223080 8/1998
JP A-2000-306454 11/2000
JP A-2001-140513 5/2001

* cited by examiner

*Primary Examiner*—Daryl C Pope
(74) *Attorney, Agent, or Firm*—Posz Law Group, PLC

(57) ABSTRACT

An ID code is wirelessly sent to a device, such as a keyless-entry system or a keyless-starter system mounted on an automobile, from a portable transmitter. Electronic components including tact switches for transmitting signals are all contained in a resin case composed of a front case and a rear case connected to each other. Front openings are formed on the font case, and the tact switches are disposed in the resin case so that they face the respective front openings. The front openings are covered with a front film formed integrally with the front case. Function displays corresponding to the respective tact switches are printed on the rear surface of the front film. The tact switches are pushed from the front surface of the front film.

11 Claims, 8 Drawing Sheets

PORTABLE TRANSMITTER HAVING TACT SWITCHES WITH FRONT FILM

CROSS-REFERENCE TO RELATED APPLICATION

This application is based upon and claims benefit of priority of Japanese Patent Application No. 2003-106703 filed on Apr. 10, 2003, the content of which is incorporated herein by reference.

BACKGROUND OF THE INVENTION

1. Field of the Invention

The present invention relates to a portable transmitter, which is advantageously used as a transmitter in a keyless-entry system for an automobile and in a keyless-starter system.

2. Description of Related Art

An example of this kind of transmitter is disclosed in JP-A-2001-140513. A transmitter similar to the disclosed transmitter is made by the inventors of this application as a prototype, which is briefly shown in FIG. 11. A printed circuit board 31 on which tact switches 32 are mounted, knobs 170 for pushing the tact switches 32 and all other components are contained in a case composed of a front case 110 and a rear case 120. The front case 110 is connected to the rear case 120 by inserting projections 110*a* formed on the front case 110 into depressions 120*a* formed on the rear case 120. A button-type battery 20 for supplying power to the electronic components is also contained in the case. The printed circuit board 31 is covered with a water-protecting cover 18*a*, and a seal member 18*b* is disposed between the front case 110 and the rear case 120 to keep the case water-tight.

Front openings 110*f* are formed in the front case 110, and the knobs 170 are exposed from the openings 110*f*. Function displays 170*b*, 170*c*, 170*d*, which show figures or characters corresponding to devices to be operated by pushing the respective knobs, are formed by molding colored resin materials on the knobs 170. If the function displays were printed on the knobs 170, they would be erased by being frequently touched. In this prototype, the function displays 170*b*, 170*c*, 170*d* are formed by molding so that they are not erased in a long term use of the transmitter.

It is necessary to provide a certain space or clearance between the knob 170 and the front opening 110*f* in inserting the knob 170 into the opening 110*f*. It is highly possible that clearances at four sides of the openings 110*f* are not equally formed, damaging an ornamental design of the transmitter. When changes in the function displays are required, dies for molding the respective function displays have to be newly prepared. This makes production costs high. Further, it may be required to increase a repulsive force of the knob 170 against a pushing force in order to avoid inadvertently pushing the knob. It is difficult to increase the repulsive force in the prototype structure because the repulsive force is exclusively determined by the repulsive force of the tact switch 32 itself.

SUMMARY OF THE INVENTION

The present invention has been made in view of the above-mentioned problem, and an object of the present invention is to provide an improved portable transmitter, in which the function displays can be easily changed according to applications and the repulsive force of the tact switch is easily adjusted without increasing manufacturing costs, while improving the ornamental design of the transmitter at the same time.

The portable transmitter includes an electronic circuit board, a battery for supplying power to the electronic circuit board, tact switches for transmitting signals by pushing them, and a transponder, all these components being contained in a resin case. An ID code (an identification code) that allows a device to be operated upon receipt of the ID code is wirelessly transmitted from the portable transmitter to the device such as a keyless-entry system or a keyless-starter system for an automobile. When the battery voltage is normal, the ID code is transmitted from the electronic circuit board, and when the battery voltage is abnormally low, the ID code is transmitted from the transponder.

The resin case of the portable transmitter is composed of a front case and a rear case, both being connected to each other. Front openings are formed in the front case, and the tact switches mounted on the printed circuit board are contained in the case so that they face the respective openings. The front openings are covered with a front film that is integrally formed with the front case, and the tact switches are also covered with the front film. The tact switches are pushed from the front side of the case via the front film. In this manner, the front surface of the transmitter can be made smooth and an ornamental design of the transmitter is greatly improved. At the same time, the resin case is kept water-tight by the front film integrally formed with the front case.

The front film is composed of a transparent resin sheet, on the rear surface of which function displays (pictures or letters showing functions corresponding to respective tact switches, such as door-lock, door-unlock, etc.) are printed. The function displays can be easily changed according to applications. A repulsive force of a tact switch against a force pushing the tact switch is a sum of the repulsive force of the tact switch itself and a resilient force of the front film. The resilient force of the front film depends on the size of the front opening among other factors. Accordingly, the repulsive force of the tact switch can be relatively easily adjusted according to user's requirements.

Preferably, a spacer is disposed between the front film and each tact switch to adjust a distance between the front film and the respective tact switches. The spacer may be integrally formed with the front case, or it may be integrally formed with a water-preventing cover covering the printed circuit board.

Other objects and features of the present invention will become more readily apparent from a better understanding of the preferred embodiment described below with reference to the following drawings.

DETAILED DESCRIPTION OF THE PREFERRED EMBODIMENT

Figure 1:
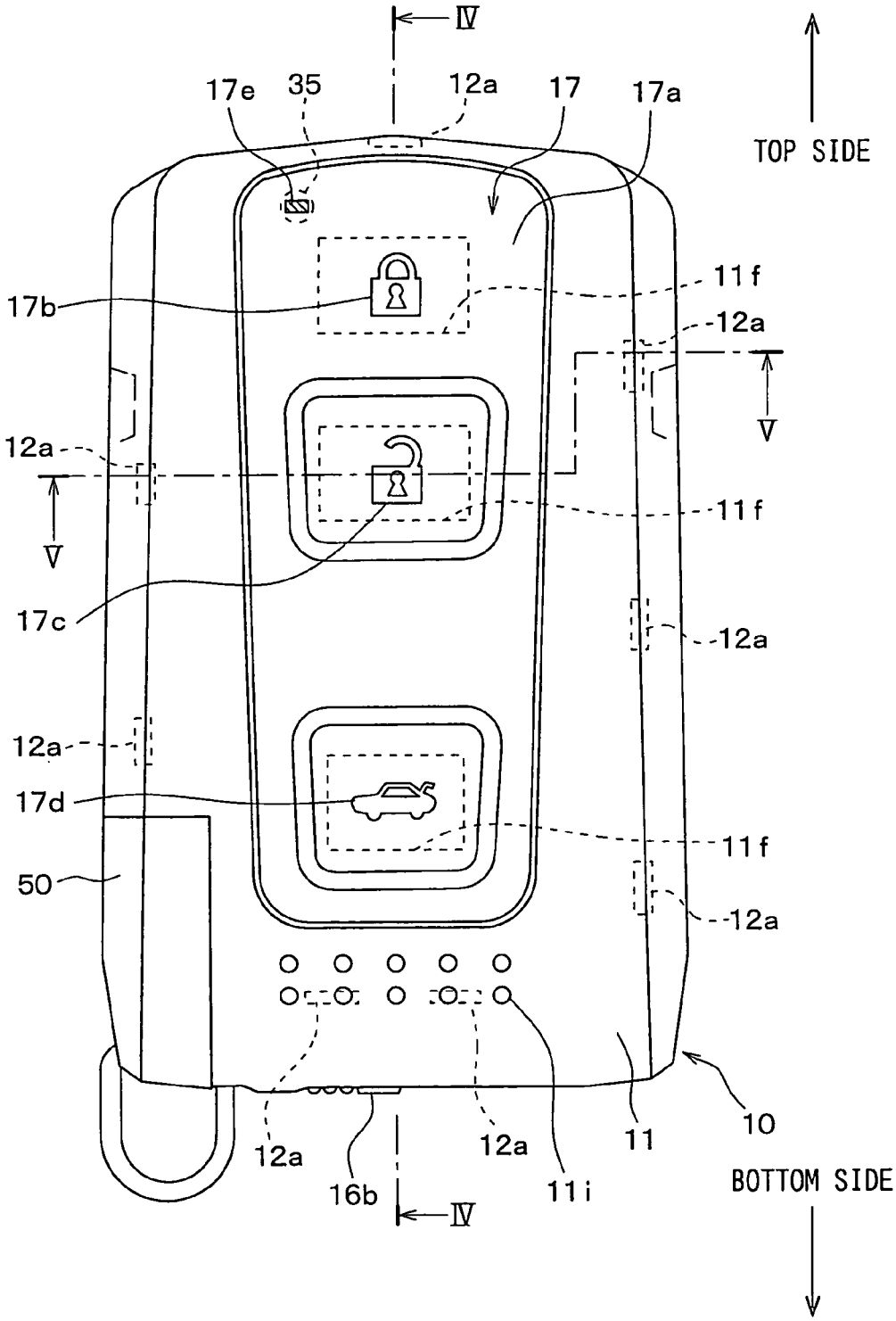
FIG. 1 is a plan view showing a portable transmitter according to the present invention, viewed from a front side thereof.

A preferred embodiment of the present invention will be described with reference to accompanying drawings. As an example of the portable transmitters of the present invention, a transmitter for used in a keyless-entry system of an automobile will be described. In the keyless-entry system, as well known, an identification code (ID code) is wirelessly transmitted to an automobile from a portable transmitter. When the ID code sent from the transmitter coincides with an ID code pre-stored in the automobile, the door is automatically locked or unlocked according to a signal showing an intention of the user. In this manner, the user of the automobile is able to lock or unlock the door without using a mechanical key from a position a certain distance apart from the automobile.

A keyless-starter system is also known hitherto. In the keyless-starter system, an automobile engine is automatically started upon receipt of an ID code wirelessly transmitted from a portable transmitter. Thus, the engine can be started without using a mechanical key in the similar manner as in the keyless-entry system. The portable transmitter according to the present invention is also applicable to other wireless control systems such as a system for starting a motor in an electric vehicle.

Referring to FIGS. 1–10, the structure and the function of the portable transmitter of the present invention will be described. The portable transmitter is composed of a resin case 10 and components contained therein. The components include a battery (a button-type) 20, an electronic circuit board 30, a transponder 40 and a mechanical key 50.

The case 10 is composed of a front case 11 and a rear case 12, both being connected not to be separated from each other (undetachably connected). The components of the transmitter are contained therein before the front case 11 is connected to the rear case 12. The structure connecting the front case 11 to the rear case 12 is shown in FIG. 6 in a scale enlarging a part of a cross-sectional view shown in FIG. 5. The front case 11 includes plural front hooks 11*a* extending toward the rear case 12, and the rear case 12 includes plural rear hooks 12*a* for engaging with the front hooks 11*a*.

As shown in FIG. 6, a projection 11*b* and a depression 11*c* are formed on the front hook 11*a*. Similarly, projection 12*b* and depression 12*c* are formed on the rear hook 12*a*. The projection 11*b* of the front hook 11*a* engages with the depression 12*c* of the rear hook 12*a*, and the projection 12*b* of the rear hook 12*a* engages with the depression 11*c* of the front hook 11*a*. A tapered surface 11*d* is formed on the projection 11*b* so that the projection 11*b* easily engages with the depression 12*c*. Similarly, a tapered surface 12*d* is formed on the projection 12*b* so that the projection 12*b* easily engages with the depression 11*c*. Engaging surfaces 11*e* and 12*e* of respective projections 11*b* and 12*b* extend substantially in a longitudinal direction of the case 10. Therefore, it is impossible to separate the front case 11 from the rear case 12 without breaking either one of the front hook 11*a* or the rear hook 12*a*. As also shown in FIG. 6, a first seal member 18*b*, which is integrally formed with a water-preventing cover 18*a* using a rubber material, is disposed between the front case 11 and the rear case 12.

Figure 4:
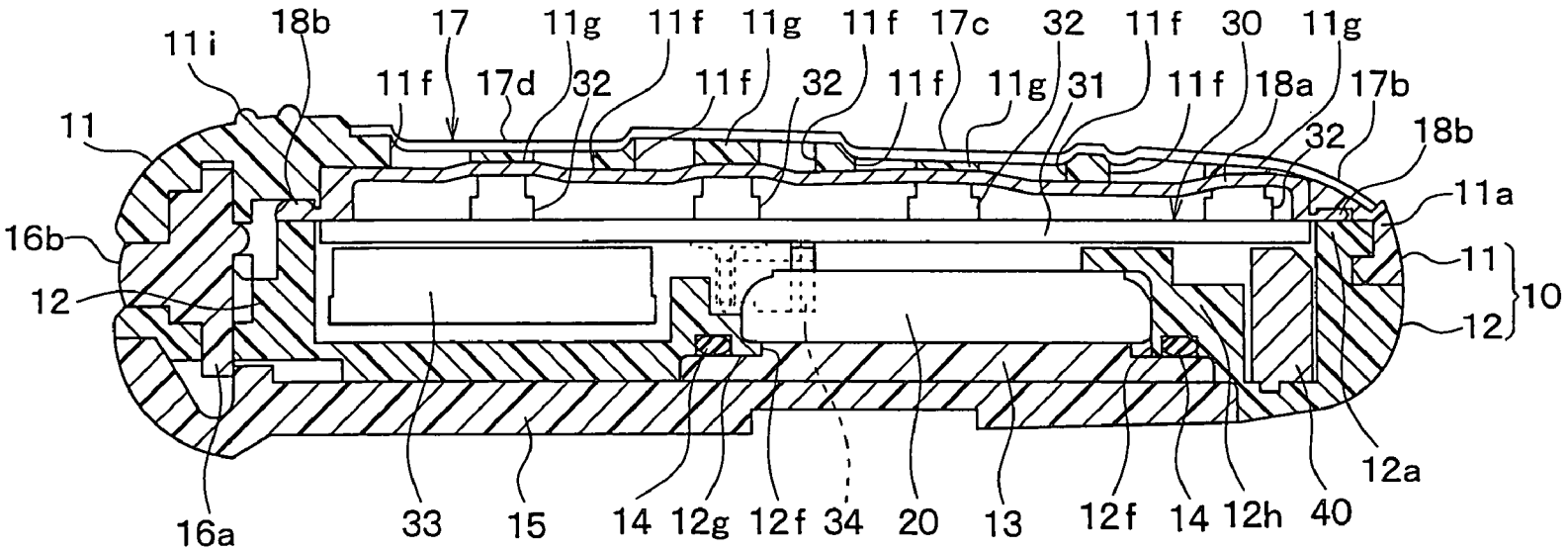
FIG. 4 is a cross-sectional view showing the transmitter, taken along line IV—IV shown in FIG. 1.

As shown in FIG. 4, the battery 20 that supplies power to the electronic circuit board 30 is contained in the case 10. The battery 20 can be loaded or unloaded through an opening 12*f* formed in the rear case 12 without separating the front case 11 from the rear case 12. A projected lip 12*g* extending toward the opening 12*f* serves as a member for preventing the battery 20 from dropping off. A battery cover 13 closing the opening 12*f* is fixed to the rear case 12 with screws N (shown in FIG. 8). The battery cover 13 can be removed by loosening the screws N when necessary for replacing a worn battery with a new one. A second seal member 14 (an O-ring made of rubber) is disposed around the opening 12*f* to be compressed with the battery cover 13 to thereby keep the inner space water-tight.

Figure 8:
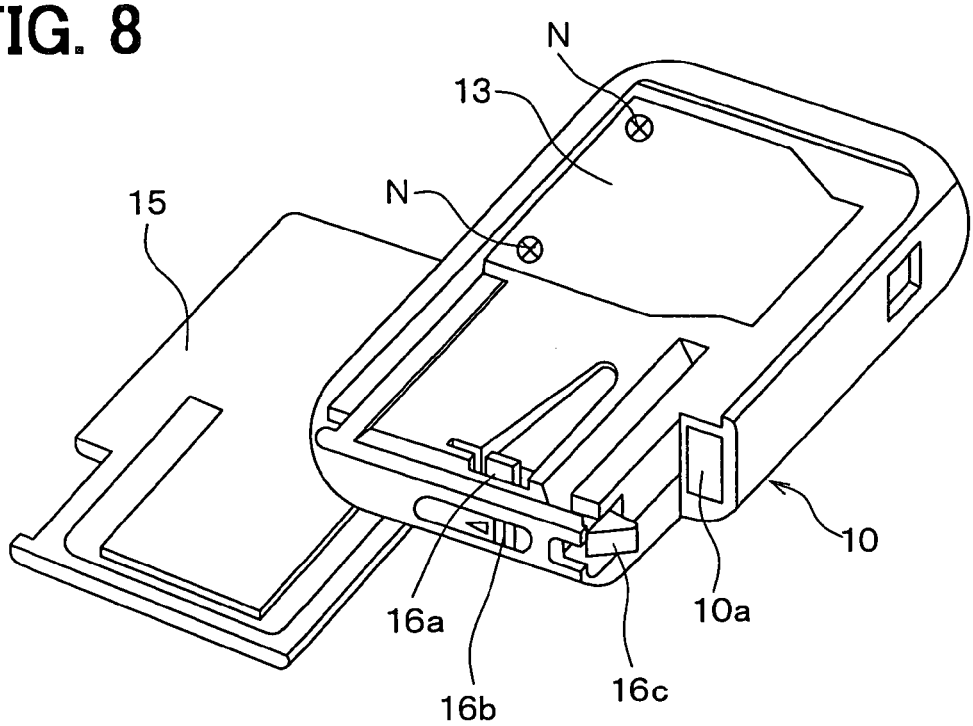
FIG. 8 is a perspective view showing the rear side of the transmitter, with a sliding cover covering an opening at the rear side removed.
Figure 9:
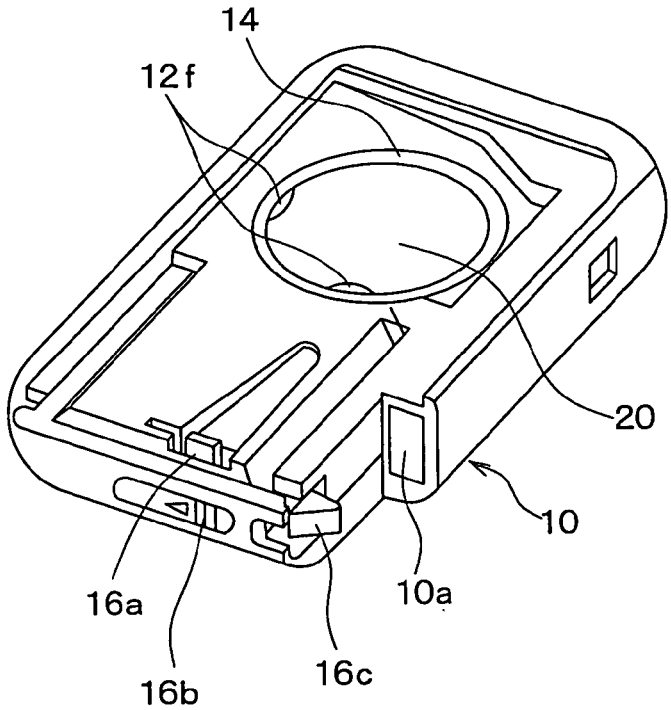
FIG. 9 is a perspective view showing the rear side of the transmitter, with both of a sliding cover and a battery cover removed.

The rear surface of the transmitter is covered with a sliding cover 15 after the battery cover 13 is fixed to the rear case 12 with the screws N. FIG. 8 shows the rear side of the transmitter with the sliding cover 15 removed, and FIG. 9 shows the rear side with both of the battery cover 13 and the sliding cover 15 removed. The sliding cover 15 can be fixed to or removed from the rear surface by sliding the sliding cover 15 in the longitudinal direction of the case 10.

As shown in FIGS. 8 and 9, a hook 16*a* for stopping the sliding cover 15 at its position is provided on the rear surface of the case 10. A lever 16*b* connected to the hook 16*a* is provided at the bottom side of the case 10. The hook 16*a* stopping the sliding cover 15 is released by operating the lever 16*b*. The mechanical key 50 is contained in a space 10*a* formed in the case 10. The mechanical key 50 can be taken out from the space 10*a* by releasing a key hook 16*c* and by sliding the mechanical key 50 in the longitudinal direction of the case 10. The key hook 16*c* functions to fixedly contain the mechanical key 50 in the space 10*a*. The key hook 16*c* is connected to the lever 16*b*. The key hook 16*c* can be moved to the position releasing the mechanical key 50 by operating the lever 16*b*.

As shown in FIG. 4, the electronic circuit board 30 is formed by mounting tact switches 32, an antenna 33, a terminal 34, an integrated circuit and other components on a printed circuit board 31. The printed circuit board 31 is fixedly mounted on the rear case 12 from its front side. The tact switches 32 are positioned on the front surface of the printed circuit board 31. The terminal 34 to be connected to a plus terminal of the battery 20, another terminal to be connected to a minus terminal of the battery 20, and the antenna 33 are mounted on the rear surface of the printed circuit board 31.

The transponder 40 is press-fitted to the rear case 12 so that it can be firmly fixed to the rear case 12. The transponder 40 is separated from the battery 20 by a separating wall 12*h* to prevent the transponder 40 from being taken out from the opening 12*f* when the battery cover 13 is removed. The electronic circuit board 30 is powered by the battery 20 and is adapted to automatically transmit the ID code. When the tact switch 32 is pushed by the user, the ID code is transmitted from the electronic circuit board 30.

Figure 5:
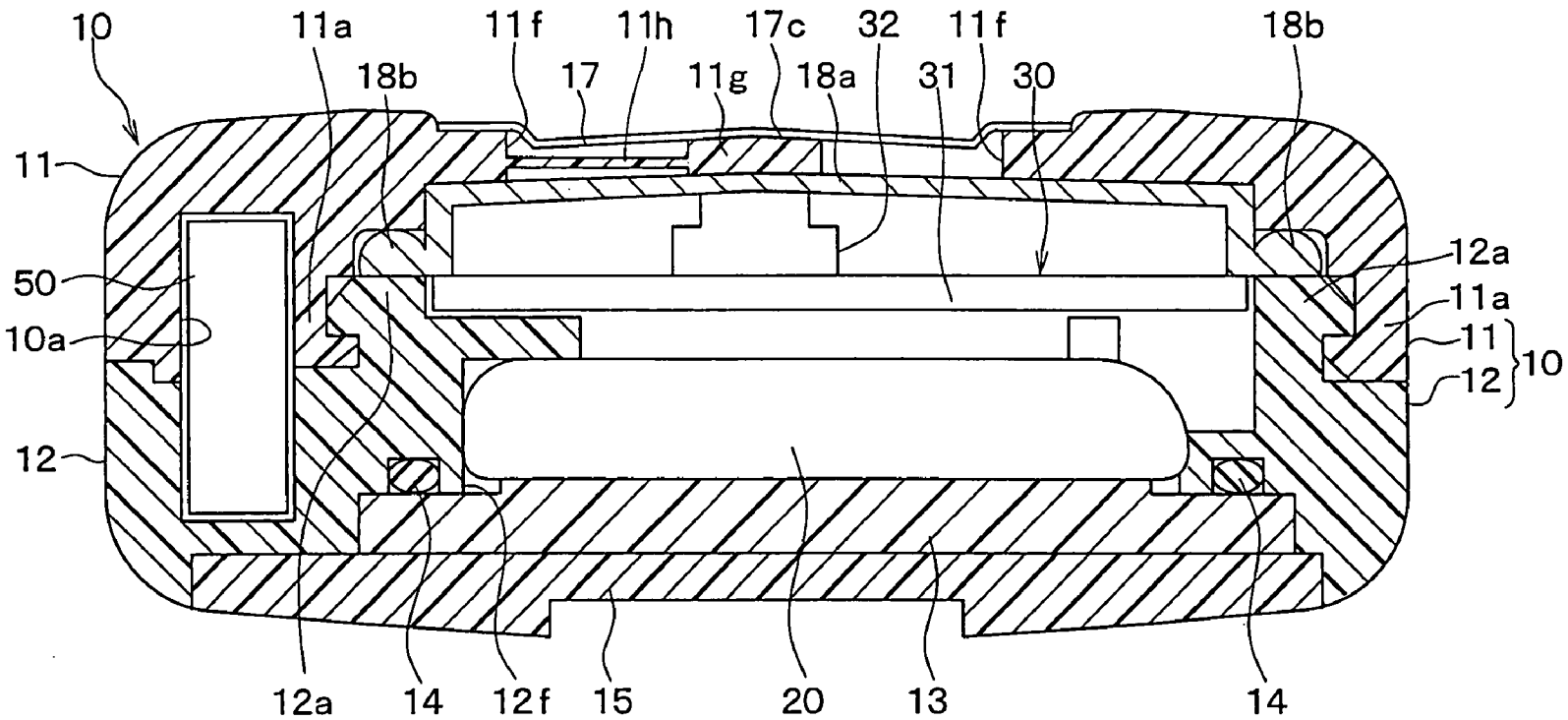
FIG. 5 is a cross-sectional view showing the transmitter, taken along line V—V shown in FIG. 1.
Figure 6:
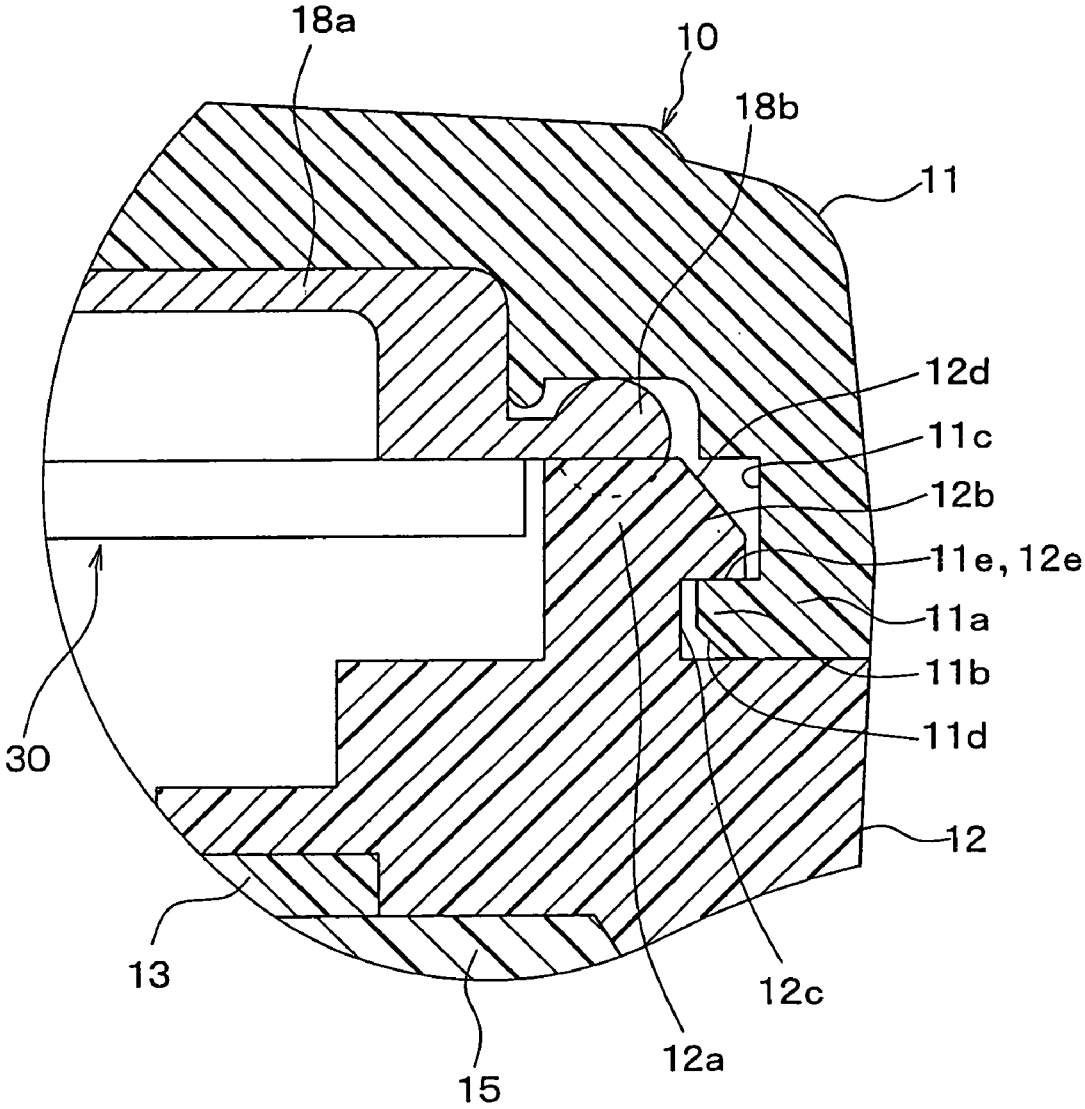
FIG. 6 is a cross-sectional view showing a portion where a front case engages with a rear case, in an enlarged scale.

As shown in FIGS. 1, 4 and 5, openings 11*f* corresponding to the respective tact switches 32 are formed on the front surface of the front case 11. The openings 11*f* are covered with a front film 17 that is integrally formed with the front case 11. By pushing the front film 17 at a position corresponding to a particular tact switch 32, the tact switch 32 can be operated. The front film 17 is formed by printing function displays 17*b*, 17*c*, 17*d* (pictures or letters showing functions) on the rear surface of a transparent resin film 17*a*. The printing process may be selected from various methods, such as silk printing with ink, other screen printing methods and photographic printing with toner. Since the function displays are printed on the rear surface, they are not erased by frequently touching the front surface. Background designs or pictures are also printed on the rear surface of the front film 17 to enhance the ornamental design of the transmitter by hiding the components located behind the front film 17.

The transparent resin film 17*a* is made of a resin material, such as polyethylene terephthalate (PET), polyvinyle chloride (PVC), polyethylene naphthalate (PEN) or polycarbonate (PC). The thickness of the transparent resin film 17*a* has to be set in an appropriate range. If it is too thick, the resilient force against a pushing force becomes too high, while if it is too thin, its mechanical strength becomes insufficient. In this embodiment, therefore, the thickness of the transparent resin film 17*a* is set in a range from 100 μm to 500 μm.

A repulsive force against a force pushing the tact switch 32 is a sum of a spring back force of the tact switch itself and a resilient force of the front film 17. As the size of the opening 11*f* becomes smaller, the resilient force against the force pushing the tact switch 32 becomes larger. Therefore, the size of the opening 11*f* is determined to obtain an optimum repulsive force against the force pushing the tact switch 32.

As shown in FIG. 1, the function display 17*b* corresponds to a door-lock function, 17*c* to a door-unlock function and 17*d* to a trunk-opening function. That is, when the tact switch 32 corresponding to the function display 17*b* is pushed, a signal for locking the door is transmitted. When the tact switch 32 corresponding to the function display 17*c* is pushed, a signal for unlocking the door is transmitted. Similarly, when the tact switch 32 corresponding to the function display 17*d* is pushed, a signal for opening a trunk is transmitted. Though four tact switches 32 are provided as shown in FIG. 4, only three functions are allocated to the respective tact switches 32 as shown in FIG. 1. Therefore, in this particular arrangement, one more function can be allocated to the vacant tact switch 32.

Figure 7:
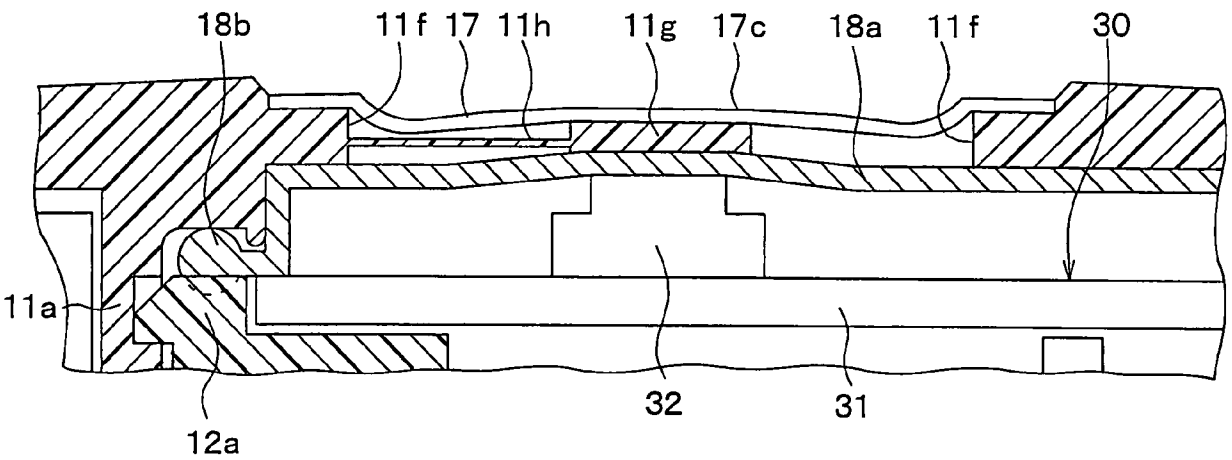
FIG. 7 is a cross-sectional view showing a portion shown in FIG. 5 in an enlarged scale.

The front film 17 is integrally molded together with the front case 11, leaving the openings 11*f* un-molded. Therefore, each opening 11*f* is circularly surrounded by the molded portion. Thus, the openings 11*f* are sealed by the molded portion and kept water-tight. As shown in FIG. 7, a spacer 11*g* connected to the front case 11 through a bridge 11*h* is formed together with the front case 11 by resin molding. The spacer 11*g* is disposed between the front film 17 and each tact switch 32. The thickness of the spacers 11*g* is different from spacer to spacer to adjust a distance between the front film 17 and each tact switch 32. This adjustment is necessary because the front film 17 is not flat but curved as shown in FIG. 4. The plane shape of the spacer 11*g* is substantially the same as the plane shape of the tact switch 32. It is round in this particular embodiment. The plane area of the spacer 11*g* is made a little larger than the plane area of the tact switch 32.

As shown in FIG. 4 (details shown in FIG. 6), a first sealing member 18*b* is disposed between the front case 11 and the rear case 12 to seal the portion connecting both cases 11, 12. The first sealing member 18*b* is integrally formed with a water-preventing cover 18*a* that covers an entire surface of the electronic circuit board 30. The first sealing member 18*b* including the water-preventing cover 18*a* is made of a rubber material.

Referring again to FIG. 1, a light source 35 such as a light emitting diode is provided in the case 10, and the light from the light source 35 is emitted through a transparent portion 17*e* of the front film 17. In this embodiment, the light is lit when the battery voltage is normal, and the light is turned off when the battery voltage decreases to a level that is unable to operate the electronic circuit board 30.

Figure 2:
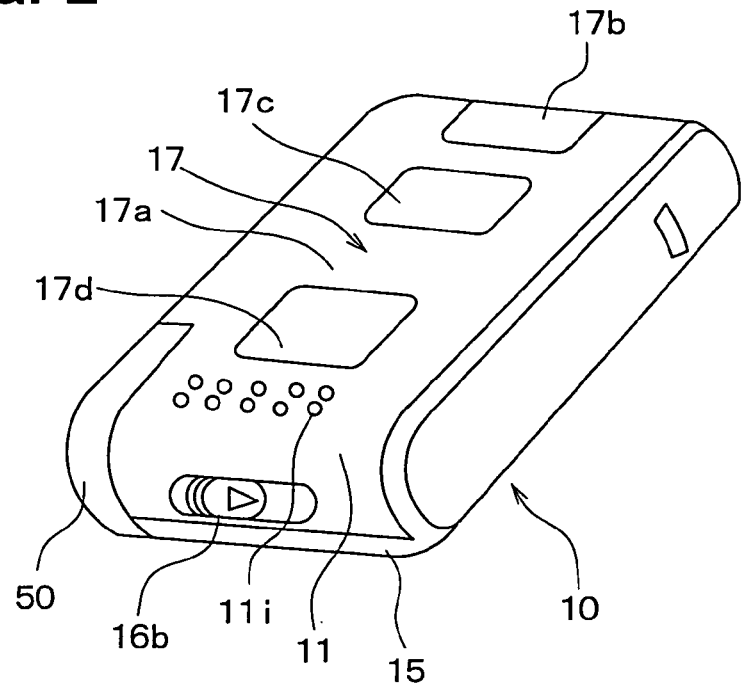
FIG. 2 is a perspective view showing front and bottom sides of the portable transmitter shown in FIG. 1.
Figure 3:
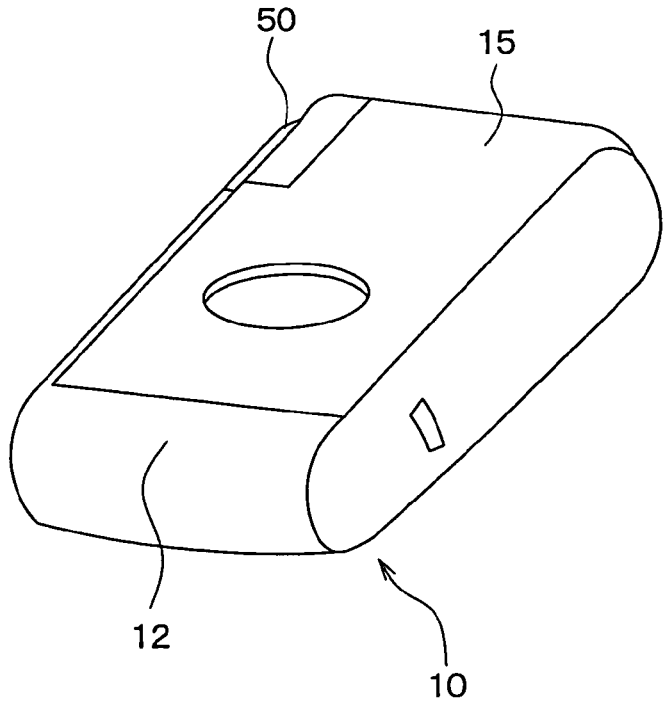
FIG. 3 is a perspective view showing rear and top sides of the same portable transmitter.

As shown in FIGS. 1 and 2, plural projections 11*i* are formed on the front surface of the front case 11, so that the user can recognize the top side and the bottom side of the transmitter by blind-touch. As seen in FIG. 4, portions of the front film 17 corresponding to the function displays 17*b*, 17*c*, 17*d* are a little depressed from other portions, so that the user can find the respective function displays by blind-touch. Depressing the portions corresponding to the function displays also helps avoid unintended operation of the transmitter.

Now, operation of the transmitter will be described. First, operation under a normal condition where the battery voltage is normal, i.e., higher than a predetermined level will be explained. When the transmitter is located within a first area which is apart from an automobile by a predetermined distance, a receiver mounted on the automobile receives the ID code automatically transmitted from the transmitter. If the ID code pre-installed in the receiver coincides with the ID code transmitted from the transmitter, an actuator for locking or unlocking the door is operated.

On the other hand, when the transmitter is located in a second area which is farther from the automobile than the first area, the ID code transmitted from the transmitter is not received by the receiver mounted on the automobile. In this case, the ID code is transmitted from the transmitter by manually pushing the tact switch 32, and this ID code can be received by the receiver. Upon receiving the ID code, the actuator is similarly operated. In this manner, the door is locked or unlocked without using a mechanical key.

In the case of the keyless-starter system, when the user possessing the transmitter sits on the automobile seat, the ID code automatically transmitted from the transmitter is received by the on-board receiver. If the received ID code coincides with a pre-installed ID code, an ignition switch is turned on and an engine is started. Thus, the engine is automatically started without using a mechanical key.

Secondly, operation under an abnormal condition where the voltage of the battery 20 dropped to a voltage level that is unable to operate the electronic circuit board 30 for transmitting the ID code will be explained. The user may take out the mechanical key 50 contained in the transmitter by operating the lever 16*b* to release the key hook 16*c*. The user may lock or unlock the door with this mechanical key 50.

When the user wants to start the engine under the abnormal condition, the user inserts the transmitter into a slot formed near a driver's seat. A caller installed in the slot sends a signal requesting the ID code to the transponder 40 contained in the transmitter. Electric power is automatically supplied to the transponder 40 from the automobile by means of electromagnetic induction, and the transponder 40 transmits the ID code to an on-board receiver. If the ID code received by the on-board receiver coincides with a pre-installed ID code, the ignition switch is turned on to start the engine. The ID codes mentioned above are all encrypted for security purpose.

Figure 11:
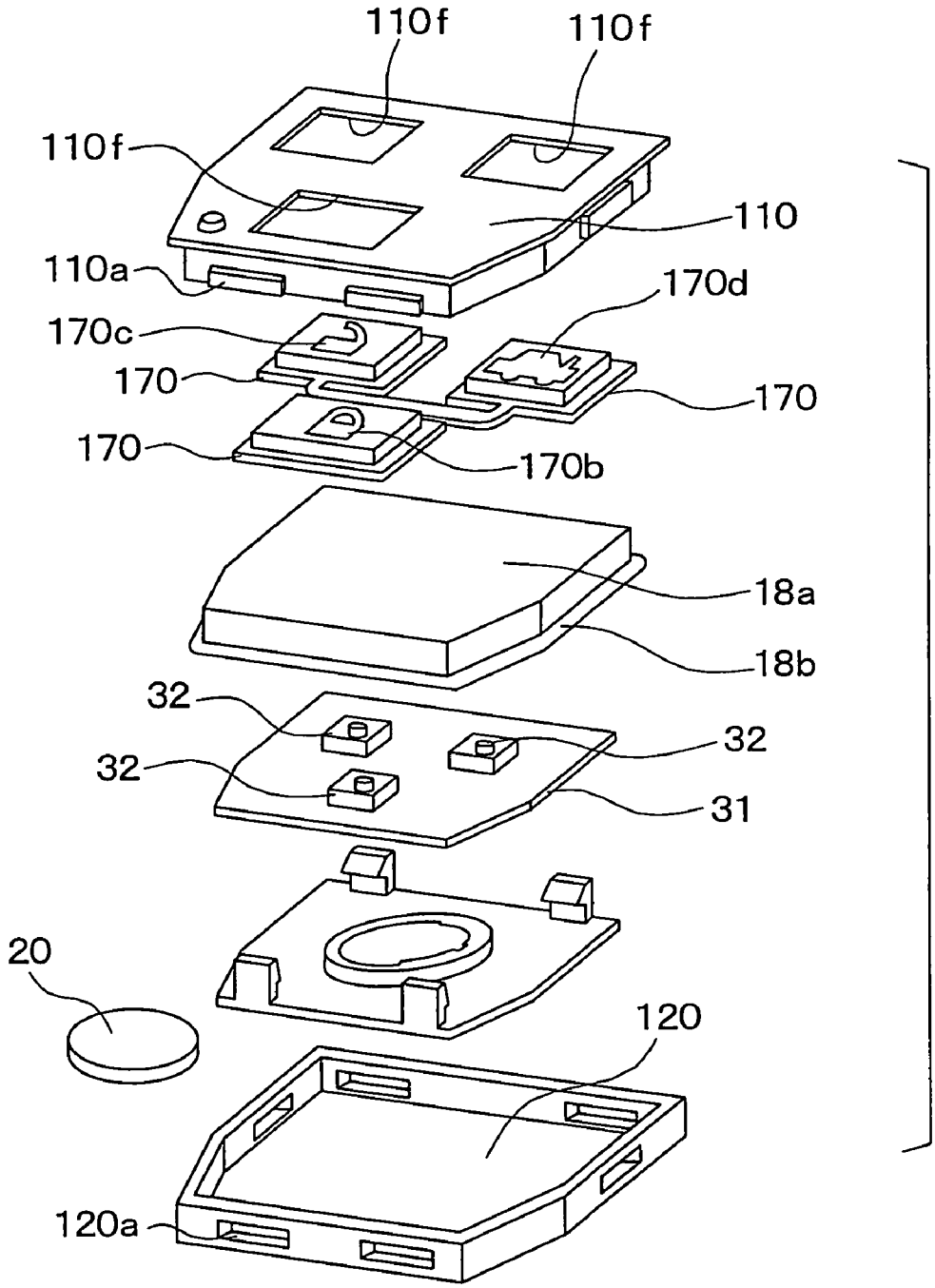
FIG. 11 is an exploded view showing a portable transmitter made by applicants as an prototype sample.

The following advantages are obtained in the present invention described above. The function of the knobs 170 in the prototype shown in FIG. 11 can be performed by the front film 17. Therefore, the knobs 170 for pushing the tact switches 32 can be eliminated, and the front surface of the case 10 can be completely covered with the front film 17 without leaving any clearance. Thus, the ornamental design of the portable transmitter is considerably enhanced. In addition, the transmitter can be made thinner by eliminating the knobs.

Since the function displays 17*b*, 17*c*, 17*d* are printed on the rear surface of the front film 17, they are not erased or deteriorated by frequent touch on the front film 17. The function displays 17*b*, 17*c*, 17*d* can be easily changed according to the applications only by changing printing patterns without increasing manufacturing costs. The repulsive force of the tact switch 32 can be easily adjusted according to the user's requirement. Since the repulsive force is the sum of the repulsive force of the tact switch 32 itself and the resilient force of the front film 17, the total repulsive force can be increased or decreased by changing the size of the front opening. The resilient force of the front film 17 can be increased by reducing the opening size.

Since the spacer 11*g* is disposed between the tact switch 32 and the front film 17, the tact switch 32 does not directly contact the function displays 17*b*, 17*c*, 17*d* printed on the rear surface of the front film 17. Accordingly, the function displays are not erased by abrasion with the tact switch 32. In addition, there is no relative movement between the front film 17 and the spacer 11*g* because both are integrally formed. This also helps prevent the function displays from being peeled off.

Figure 10:
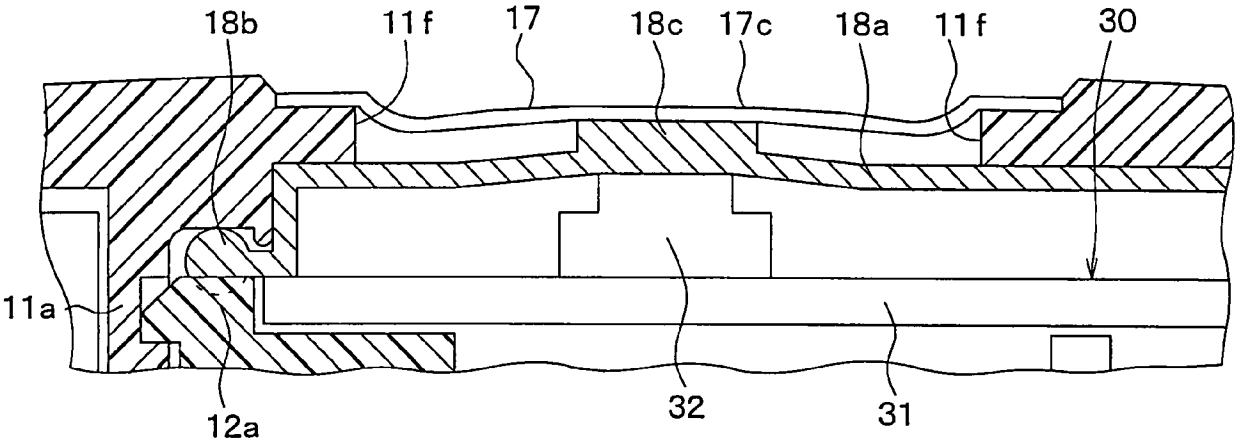
FIG. 10 is a cross-sectional view showing a portion shown in FIG. 5 in an enlarged scale and slightly modified in form.

The spacer 11*g* shown in FIG. 7 may be modified to a spacer 18*c* shown in FIG. 10. In this modified form, the spacer 18*c* is integrally formed with the water-preventing cover 18*a* which is integrally connected to the first seal member 18*b*. Since the spacer 18*c* is made of rubber (the same material forming the first seal member 18*b* and the water-preventing cover 18*a*), the function displays 17*b*, 17*c*, 17*d* do not easily peeled off even though there is a little abrasion between the printed function displays and the spacer 18*c*.

The present invention is not limited to the embodiment described above, but it may be variously modified. For example, the water-preventing cover 18*a* may be eliminated by perfectly sealing the front openings 11*f* with front film portions, which are integrally connected to the front case and surround respective openings 11*f*. Though the first area where the ID code is automatically transmitted and the second area where the ID code is manually transmitted are provided in the foregoing embodiment, it is, of course, possible to eliminate the first area. In other words, the ID code may be transmitted only by pushing the tact switch 32.

The present invention is applied to the transmitter used in the keyless-entry system and the keyless-starter system in the foregoing description. However, the transmitter according to the present invention may be used in other systems. Further, application of the present invention is not limited to the automotive systems, but it may be applied to other systems such as a keyless entry system for doors of independent houses or apartment rooms.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A portable transmitter comprising:

a resin case having front openings tact switches for transmitting signals by pushing the same, the tact switches being contained in the resin case at positions facing the front openings; and a front film covering the front openings, the front film being integrally formed with the resin case except portions of the front film corresponding to the front openings, wherein:

the front film is a transparent resin film sheet, on the rear surface of which function displays are printed.

2. The portable transmitter as in claim 1, wherein:

the portions of the front film integrally formed with the resin case surrounds each of the front openings.

3. The portable transmitter as in claim 1 further including a light source contained in the resin case, wherein:

a transparent portion from which light from the light source is emitted is formed on the front film.

4. The portable transmitter as in claim 1, wherein:

a spacer is disposed between the front film and each of the tact switches.

5. The portable transmitter as in claim 4, wherein:

the spacer is integrally formed with the resin case.

6. The portable transmitter as in claim 4, wherein:

the resin case is composed of a front case having the front openings and a rear case, both cases being connected to each other;

a rubber seal member for keeping the resin case water-tight is disposed between the front case and the rear case; and the spacer is integrally formed with the rubber seal member.

7. The portable transmitter as in claim 6, wherein:

the front openings of the front case is covered with the seal member from the rear side of the front openings.

8. A portable transmitter comprising:

a resin case composed of a front case having front openings and a rear case, both cases being firmly connected to each other;

tact switches for transmitting signals by pushing the same, the tact switches being contained in the resin case at positions facing the front openings;

a front film covering the front openings, the front film being integrally connected to the front case except portions of the front film corresponding to the front openings, the front film being a transparent resin sheet on the rear surface of which function displays are printed;

a seal member disposed between the front case and the rear case for keeping the resin case water-tight; and a water-preventing cover disposed to cover the front openings from the rear side thereof, the water-preventing cover and the seal member being integrally formed with rubber.

9. The portable transmitter as in claim 1, wherein:

a plurality of front openings each corresponding to each tact switch are formed on the resin case, and the plurality of the front openings are covered with a single front film.

10. The portable transmitter as in claim 8, further including spacers, each disposed between the front film and each of the tact switches, wherein the spacers are integrally formed with the front case.

11. The portable transmitter as in claim 8, further including spacers, each disposed between the front film and each of the tact switches, wherein the spacers are integrally formed with the water-preventing cover.

* * * * *

UNITED STATES PATENT AND TRADEMARK OFFICE

CERTIFICATE OF CORRECTION

PATENT NO. : 7,046,136 B2
APPLICATION NO. : 10/819962
DATED : May 16, 2006
INVENTOR(S) : Keiichi Sugimoto and Mitsuru Nakaqawa It is certified that error appears in the above-identified patent and that said Letters Patent is hereby corrected as shown below:

Title Page, Col. 1

Correct the title in item (54) to read as:

PORTABLE TRANSMITTER HAVING TACT SWITCHES COVERED WITH FRONT FILM

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,046,136 B2
APPLICATION NO. : 10/819962
DATED : May 16, 2006
INVENTOR(S) : Keiichi Sugimoto and Mitsuru Nakagawa It is certified that error appears in the above-identified patent and that said Letters Patent is hereby corrected as shown below:

Title page

Include Foreign Application Priority Data of item (30) to read as:

April 10, 2003 (JP) 2003-106703

Signed and Sealed this

Twenty-third Day of January, 2007

JON W. DUDAS
*Director of the United States Patent and Trademark Office*